US008038805B2

(12) United States Patent
Anderson et al.

(10) Patent No.: US 8,038,805 B2
(45) Date of Patent: Oct. 18, 2011

(54) MULTI-PIECE DISHRACK FOR A DRAWER DISHWASHER

(75) Inventors: Randy Anderson, Chicago, IL (US); Kory A. Gunnerson, Lebanon, NH (US); Heather M. Hagans, Jackson, TN (US); Kristen K. Hedstrom, Orlando, FL (US); Mark E. Palm, Davie, FL (US); David K. Reynolds, Jackson, TN (US); Barry E. Tuller, Humboldt, TN (US); Rodney M. Welch, Beach Bluff, TN (US); Jeffrey N. Williams, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1209 days.

(21) Appl. No.: 11/707,171

(22) Filed: Feb. 16, 2007

(65) Prior Publication Data

US 2007/0246090 A1 Oct. 25, 2007

Related U.S. Application Data

(60) Provisional application No. 60/793,248, filed on Apr. 20, 2006.

(51) Int. Cl.
*B08B 3/00* (2006.01)
*A47G 19/08* (2006.01)
*A47F 7/00* (2006.01)

(52) U.S. Cl. ..... 134/58 D; 134/56 D; 134/57 D; 211/41.8; 211/41.9

(58) Field of Classification Search ..... 134/58 D, 134/56 D, 57 D; 211/41.8, 41.9
See application file for complete search history.

(56) References Cited

U.S. PATENT DOCUMENTS

| | | | | |
|---|---|---|---|---|
| 2,907,470 | A | 10/1959 | Abresch | |
| 3,289,683 | A | 12/1966 | Tomlin | |
| 3,680,712 | A * | 8/1972 | Jurasek | 211/59.2 |
| 3,752,322 | A | 8/1973 | Fiocca et al. | |

(Continued)

FOREIGN PATENT DOCUMENTS

| | | |
|---|---|---|
| EP | 898929 | 3/1999 |

(Continued)

OTHER PUBLICATIONS

Machine translation of JP2004-00745 (Jan. 2004).*

*Primary Examiner* — Michael Barr
*Assistant Examiner* — Charles W Kling
(74) *Attorney, Agent, or Firm* — Robert A. Bacon; Diederiks & Whitelaw, PLC

(57) ABSTRACT

A dishrack system for a drawer-type dishwasher having a tub including bottom, rear and opposing side walls includes a side portion and a readily removable base portion supported by the side portion. The side portion includes a base section having first and second leg members, and a back wall section. The leg members directly support the side portion upon the bottom wall of the tub, with the back wall section extending along one of the opposing side walls. The base portion includes a first end directly supported by the side portion and a second end which can be supported either directly by the bottom wall of the washing chamber or by another side portion. With this arrangement, the dishrack system occupies a full length and width of the tub, while the base portion can be removed without disturbing dishware items resting on the side portion (s).

21 Claims, 6 Drawing Sheets

U.S. PATENT DOCUMENTS

| | | | | |
|---|---|---|---|---|
| 4,046,261 | A | 9/1977 | Yake | |
| 4,917,248 | A | 4/1990 | Friskney | |
| 5,205,419 | A * | 4/1993 | Purtilo | 211/41.8 |
| 5,409,309 | A * | 4/1995 | Giddings et al. | 312/331 |
| 5,431,294 | A | 7/1995 | Stottmann et al. | |
| 5,601,195 | A * | 2/1997 | Finola et al. | 211/41.8 |
| 5,626,242 | A | 5/1997 | Weizer | |
| 5,649,630 | A | 7/1997 | Remmler | |
| 6,109,455 | A | 8/2000 | Schroeder | |
| 6,260,565 | B1 * | 7/2001 | Welch et al. | 134/200 |
| 6,546,942 | B2 | 4/2003 | Smith et al. | |
| 6,571,812 | B1 | 6/2003 | Lavoie et al. | |
| 6,571,965 | B1 | 6/2003 | Beck et al. | |
| 6,848,585 | B2 | 2/2005 | Van Landingham | |
| 7,137,397 | B2 | 11/2006 | Rosenbauer et al. | |
| 2003/0205250 | A1 * | 11/2003 | DeBoer et al. | 134/57 D |
| 2005/0268945 | A1 * | 12/2005 | Hedstrom et al. | 134/25.2 |

FOREIGN PATENT DOCUMENTS

| | | |
|---|---|---|
| EP | 1266603 | * 12/2002 |
| GB | 2349330 | 11/2000 |
| JP | 2003-024262 | 1/2003 |
| JP | 2003-284671 | 7/2003 |
| JP | 2003-325427 | 11/2003 |
| JP | 2004000745 | 1/2004 |
| JP | 2005000226 | 1/2005 |
| JP | 2005046301 | 2/2005 |

* cited by examiner

MULTI-PIECE DISHRACK FOR A DRAWER DISHWASHER

CROSS-REFERENCE TO RELATED APPLICATIONS

The present application claims the benefit of the filing of U.S. Provisional Patent Application Ser. No. 60/793,248 filed Apr. 20, 2006.

BACKGROUND OF THE INVENTION

1. Field of the Invention

The present invention pertains to the art of dishwashers and, more particularly, to a multi-piece dishrack system for a drawer-type dishwasher.

2. Discussion of the Prior Art

Racks for supporting items in a dishwasher are well known in the art. Typically, the racks are designed to hold dishware, utensils and other items such as pots, pans and casserole dishes. Towards that end, the racks are generally provided with various support elements that enable a consumer to arrange the dishware in such a manner so as to optimize available space on the rack. As there exists a wide array of dishwashers, racks are typically specially configured to accommodate each dishwasher model. For example, racks for industrial dishwashers are designed to ride along a conveyor belt, racks for conventional dishwashers are designed to be slidingly supported in a tub through rollers or extensible glide rails and racks for drawer-type dishwashers are designed to fit into a drawer.

In drawer-type dishwashers, the drawer or washing chamber is generally slidingly supported in a cabinet and contains or supports many, if not all, wash system components for the drawer. With this arrangement, various components, such as filters, wash arms and pump inlets are arranged in a bottom portion of the drawer, with the rack being of a length, width and height so as to readily be fitted into the drawer atop the various components. Prior to a washing operation, the consumer need simply load items to be washed upon the rack. The drawer is then slid into the cabinet and a washing operation initiated. During the washing operation, a washing fluid is introduced into the drawer through wash arms which spray the washing fluid onto the items arranged on the rack. The water and any entrained soil particles pass through the filters and into the pump inlet, at which point the water, less the soil particles, is redirected back to the wash arms. This process is repeated until the washing operation is complete.

Occasionally during a washing operation, a large food particle will become dislodged and rest upon one of the filters. Also, during loading of the items to be washed, a utensil or other item may fall and pass through the rack, landing onto one of the filters, or simply come to rest on the bottom portion of the drawer. In order to retrieve anything that falls onto the bottom portion of the drawer, the rack must be removed. If there are items on the rack, most, if not all, of the items must be removed prior to lifting the rack from the dishwasher. Unloading and reloading the rack to retrieve a fallen item can be very inconvenient, particularly when the rack is full.

Despite the existence of dishracks in the prior art, there still exists a need for an enhanced dishrack designed for use with a drawer-type dishwasher. More specifically, there exists a need for a dishrack that is formed from multiple pieces so as to conform to a full length and width of a dishwasher drawer as well as provide at least one high wall for supporting tall items such as glassware and to enable a consumer to easily install the dishrack, readily remove a portion of the dishrack and gain access to a bottom portion of a drawer without having to completely unload the dishrack.

SUMMARY OF THE INVENTION

The present invention is directed to dishrack system for a dishwasher having a support body within which is slidably mounted in a tub defining drawer. The tub includes bottom, rear and opposing side walls that collectively define a washing chamber. The dishrack system is arranged in the washing chamber for supporting articles to be washed. In accordance with one embodiment of the invention, the dishrack system includes a side portion and a base portion that is removably supported by the side portion. With this arrangement, the dishrack system can fully accupy a length and width of the washing chamber and the base portion can be removed to access the bottom wall of the tub without disturbing the side portion or any items that may be supported thereon.

In further accordance with the invention, the side portion includes a base section having first and second leg members, and a back wall section. The leg members directly support the side portion upon the bottom wall, with the back wall section extending along one of the opposing side walls. The back wall section can rest upon ribs, integrally molded into the side walls of the tub to provide additional support, particularly when the base portion is removed. The base portion includes a first end, supported by the side portion, that extends to a second end through an intermediate portion. The second end includes a pair of leg members that rest upon the bottom wall of the washing chamber.

In accordance with another embodiment of the invention, the dishrack system includes a second side portion. In a manner similar to that described above, the second side portion includes a base section having first and second leg members, and a back wall section. The leg members directly support the second side portion upon the bottom wall, with the back wall section extending along a respective one of the opposing side walls. In a manner similar to that described above, the back wall section can rest upon ribs, integrally molded into the side walls of the tub to provide additional support, particularly when the base portion is removed. With this arrangement, the dishrack system fully occupies the length and width of the washing chamber and the base portion, while being supported between the side portions, is readily removable in the event that access to the bottom wall of the washing chamber is desired.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
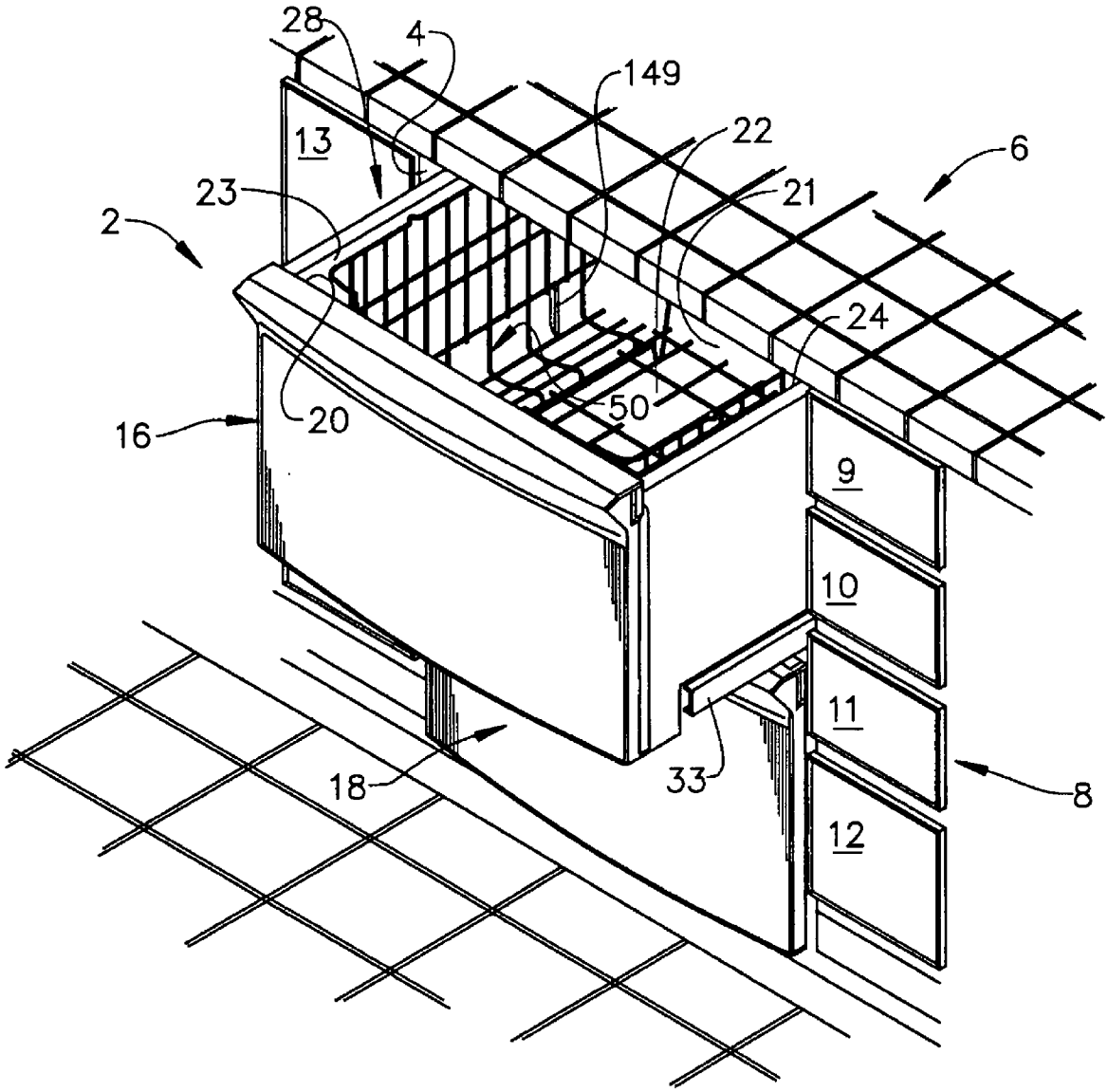
FIG. 1 is an upper right perspective view of a drawer-type dishwasher incorporating a multi-piece dishrack constructed in accordance with the present invention.

With initial reference to FIG. 1, a dishwasher constructed in accordance with the present invention is generally indicated at 2. Dishwasher 2 includes an outer support body 4 arranged below a kitchen countertop 6. Also below kitchen countertop 6 is cabinetry 8 which includes a plurality of drawers 9-12, and a cabinet door 13. Although the 1o actual dishwasher into which the present invention may be incorporated can vary, the invention is shown in connection with dishwasher 2 depicted as a dual cavity dishwasher having an upper washing unit 16 and a lower washing unit 18. Upper and lower washing units 16 and 18 take the form of a slide-out drawer units capable of operating either individually or in combination.

In the embodiment shown, upper washing unit or drawer 16 includes a front wall 20, a rear wall 21, a bottom wall 22 and opposing side walls 23 and 24 that collectively define a washing tub or chamber 28. In a manner known in the art, upper washing unit 16 is slidingly supported within the outer support body (not shown) through a pair of drawer support glides, one of which is indicated at 33. In addition, while not shown, it should be understood that each drawer 16, 18 is provided with a corresponding lid member that selectively seals about an upper opening (not separately labeled) of washing chamber 28. In any event, the above description is provided for the sake of completeness and to enable a better understanding of the drawings. The present invention is particularly directed to a multi-piece dishrack 50 for supporting articles to be exposed to a washing operation in washing chamber 28. Although not shown, it should be understood that a similar rack could be arranged in lower washing unit 18.

Figure 2:
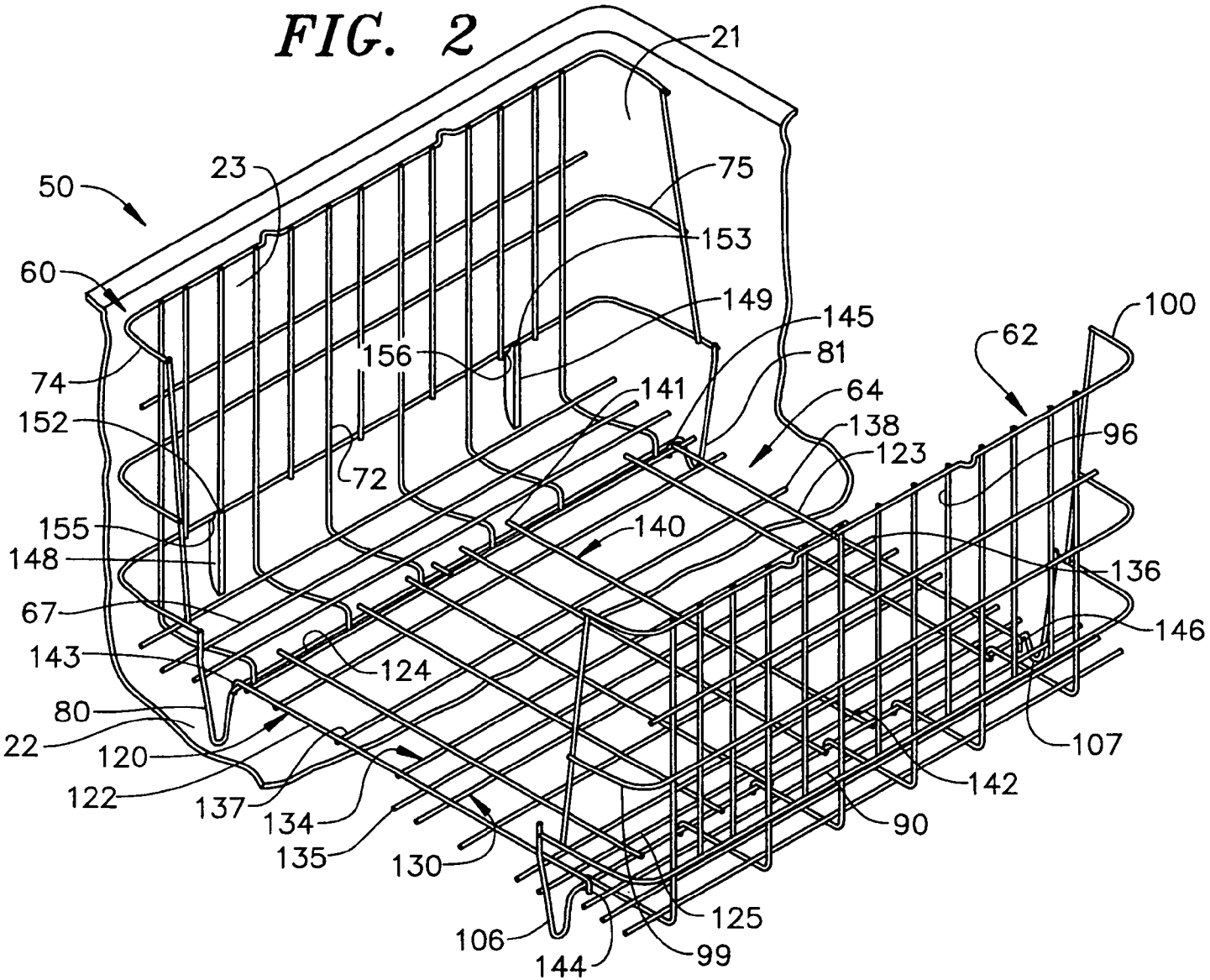
FIG. 2 is an upper right perspective view of a multi-piece dishrack constructed in accordance with a first embodiment of the present invention.
Figure 3:
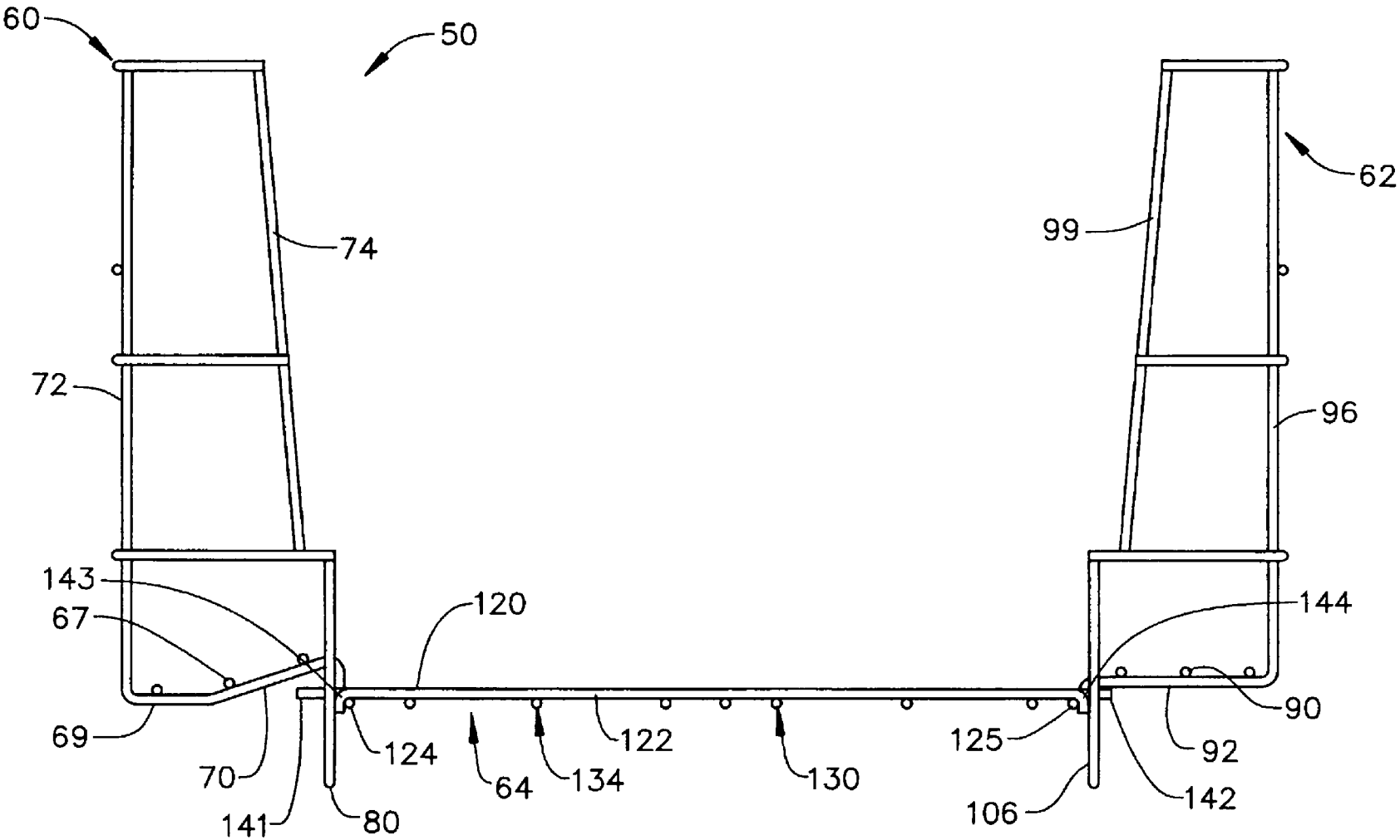
FIG. 3 is a front elevational view of the multi-piece dishrack of FIG. 1.

Reference will now be made to FIGS. 2 and 3 in describing multi-piece dishrack 50 constructed in accordance with a first embodiment of the present invention. As shown, dishrack 50 includes a first side portion 60, a second side portion 62 and a base portion 64. First side portion 60 includes a base section 67 having a horizontal portion 69 which leads to an angled or slanted portion 70. First side portion 60 also includes a back wall 72 which extends from, and is actually integrally formed with, base section 67. In accordance with the embodiment shown, back wall 72 includes a first, in-turned end section 74 and a second, in-turned end section 75. Base section 67 includes a pair of fore-to-aft spaced leg members 80 and 81 for supporting first side portion 60 upon bottom wall 22 of drawer 16.

On the other side of base portion 64, second side portion 62 includes a base section 90 having a horizontal portion 92 and a back wall section 96 provided with first and second end sections 99 and 100. Second side portion 62 is supported upon bottom wall 22 through a pair of leg members 106 and 107. More specifically, in accordance with the invention, first and second side portions 60 and 62 are positioned within washing chamber 28 such that back wall 72 extends along side wall 23 with leg members 80 and 81 resting upon bottom wall 22. Likewise, second side portion 62 extends along side wall 24 with leg members 106 and 107 resting upon bottom wall 22 of washing chamber 28.

Once first and second side portions 60 and 62 are in place, base portion 64 is inserted into washing chamber 28. In accordance with this preferred embodiment of the invention, base portion 64 rests directly upon side portions 60 and 62 so as to fully occupy a length and width of washing chamber 28 and also to be readily removable. More specifically, in the event that a consumer inadvertently drops an item, such as a utensil onto bottom wall 22, base portion 64 can be readily removed without disturbing any articles that may be supported upon first and/or second side portions 60 and 62. Likewise, if a consumer notices any large objects trapped upon or resting upon various filters (not shown) provided along bottom wall 22, base portion 64 can simply be removed, the article extracted from washing chamber 28 and base portion 64 readily re-inserted.

As best shown in FIG. 2, base portion 64 includes peripheral frame 120 having front, rear and opposing side members 122-125. First and second sets of longitudinally extending support members, indicated generally at 130 and 134 respectively, extend across and interconnect front and rear members 122 and 123. Each of the first set of longitudinally extending support members 130 includes first and second end portions 135 and 136 which project beyond front and rear members 122 and 123 respectively, while each of the second set of longitudinally extending support members 134 includes a first end portion 137 terminates at front member 122 and a second end portion 138 that projects beyond rear member 123. With this arrangement, a void is specifically created that provides clearance for the advantageous positioning of wash system components (not shown) exposed along bottom wall 22.

In addition, peripheral frame 120 includes a plurality of laterally extending support members 140 which are connected to opposing side members 124 and 125. More specifically, laterally extending support members 140 include first and second pluralities of end portions 141 and 142 which extend beyond opposing side members 124 and 125. With this construction, longitudinally extending support members 130 and 131, along with laterally extending support members 140, establish a latticework across peripheral frame 120 for supporting dishes and the like. Actually, a plurality of tine members (not shown) can be attached to support members 130, 134 and 140 in various configurations to establish multiple dish support zones.

In any case, when base portion 64 is in place, first and second pluralities of end portions 141 and 142 of each support member 140 rest upon first and second side portions 60 and 62. In a preferred form of the invention, at least two of each first and second pluralities of end portions 141, 142 include hook members indicated generally at 143-146, that provide positive engagement with base portion 64. With this construction, base portion 64 can be readily lifted from side portions 60 and 62 exposing bottom wall 22 of wash tub 28. That is, laterally extending support members 140 and, more particularly, end portions 141 and 142, are designed to rest upon base sections 67 and 90 allowing base portion 64 to be removed without disturbing side portions 60 and 62. Once removed, any foreign objects that might be resting upon bottom wall 22 can be removed and/or other components of dishwasher 2 can be accessed without the need to unload dishware from side portions 60 and 62.

In accordance with one aspect of the invention, washing chamber 28 includes a plurality of ribs, two of which are indicated at 148 and 149, integrally formed on side walls 23 and 24. That is, ribs 148 and 149 are integrally formed on side wall 23, while additional ribs (not shown) are formed on side wall 24. Ribs 148 and 149 are provided to capture and support first side portion 60 while the additional ribs (not shown) formed on side wall 24 are provided to capture and support second side portion 62. Towards that end, each rib 148 and 149 includes a corresponding tab member 152, 153 that define respective notches 155, 156. With this arrangement, first side portion 60 is placed within washing chamber 28 such that back wall 72 rests, n part, within notches 155 and 156. In this manner, first side portion 60 will remain upright even when base portion 64 is removed. Of course, it should be understood that second side portion 62 is supported in a similar manner.

Figure 4:
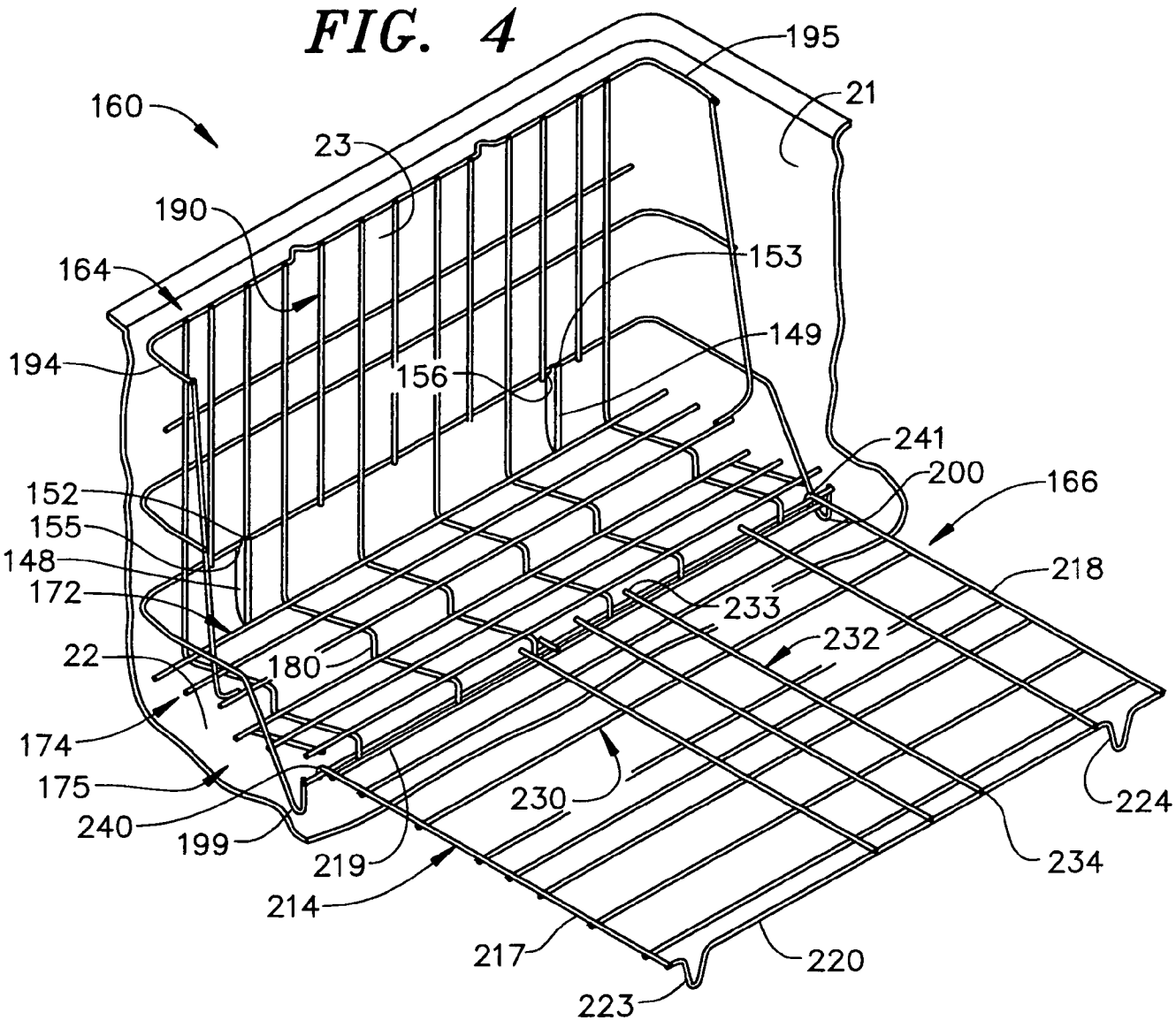
FIG. 4 is an upper right perspective view of a multi-piece dishrack constructed in accordance with a second embodiment of the present invention.
Figure 5:
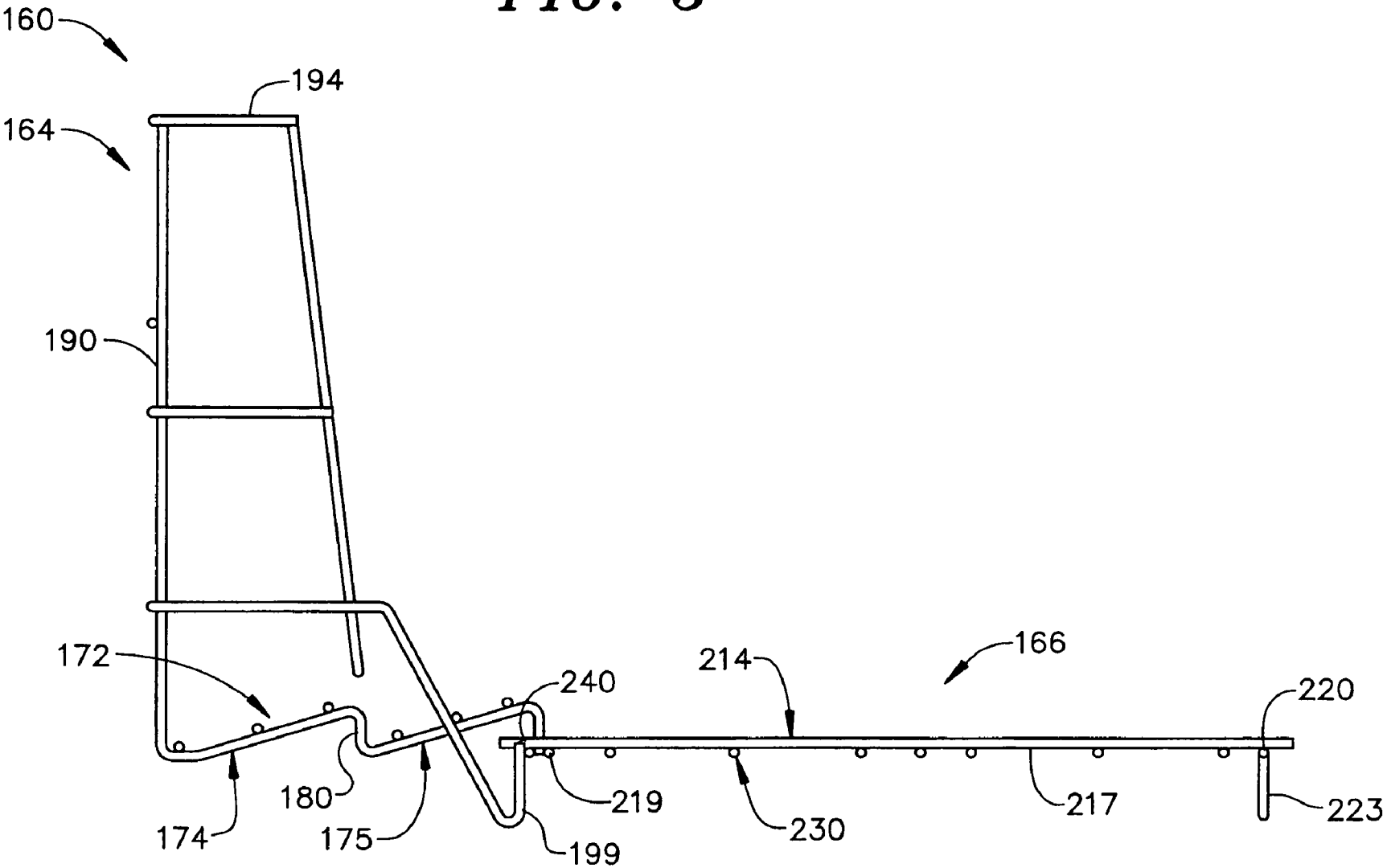
FIG. 5 is a front elevational view of the multi-piece dishrack of FIG. 4.

Reference will now be made to FIGS. 4 and 5 in describing a multi-piece dishrack 160 constructed in accordance with a second embodiment of the present invention. Dishrack 160 includes a side portion 164 and a base portion 166. Side portion 164 includes a base section 172 having first and second supporting surfaces 174 and 175 which are interconnected by a stepped region 180. First and second supporting surfaces 174 and 175 are preferably sloped laterally outwardly and downwardly for the enhanced retention of dishware, with stepped region 180 forming a divider therebetween. In this manner, base section 172 provides for flexible storage options for a consumer. In any case, base section 172 extends upward to form a back wall 190 having in-turned first and second end sections 194 and 195. Side portion 164 is also provided with a pair of leg members 199 and 200.

In accordance with the embodiment shown, side portion 164 is mounted in washing chamber 28 such that back wall 190 extends along one of opposing side walls 23 and 24, with leg members 199 and 200 directly resting upon bottom wall 22. In a manner similar to that described above, side portion 164 is supported upon rib members 148 and 149 formed on side wall 23 of washing chamber 28. Once in place, base portion 166 is arranged within washing chamber 28 across bottom wall 22. In a manner that will described more fully below, base portion 166 is supported at one end through side portion 164 and at an opposing end directly upon bottom wall 22.

As best shown in FIG. 4, base portion 166 includes a peripheral frame 214 having front, rear and opposing side members 217-220. As shown, side member 220 is integrally formed with a pair of leg members 223 and 224. That is, leg members 223 and 224 are preferably formed as downwardly projecting bends in side member 220. In any event, base portion 166 includes a plurality of longitudinally or fore-to-aft extending support members 230 which extend across and interconnect front and rear members 217 and 218, as well as a plurality of laterally extending support members 232 which extend across and interconnect opposing side members 219 and 220. As shown, each of laterally extending support members 232 includes a first end 233 secured to and actually extending beyond side member 219 and a second end 234 secured to side member 220. With this construction, base portion 166 is supported in washing chamber 28, with the first ends 233 of laterally extending support members 232 resting upon side portion 164, while leg members 223 and 224 rest directly upon bottom wall 22. In the most preferred form of the invention, first end 233 of two of the laterally extending support members 232 are provided with hook members 240, 241 that engage with base section 172 in a manner similar to that described above.

Figure 6:
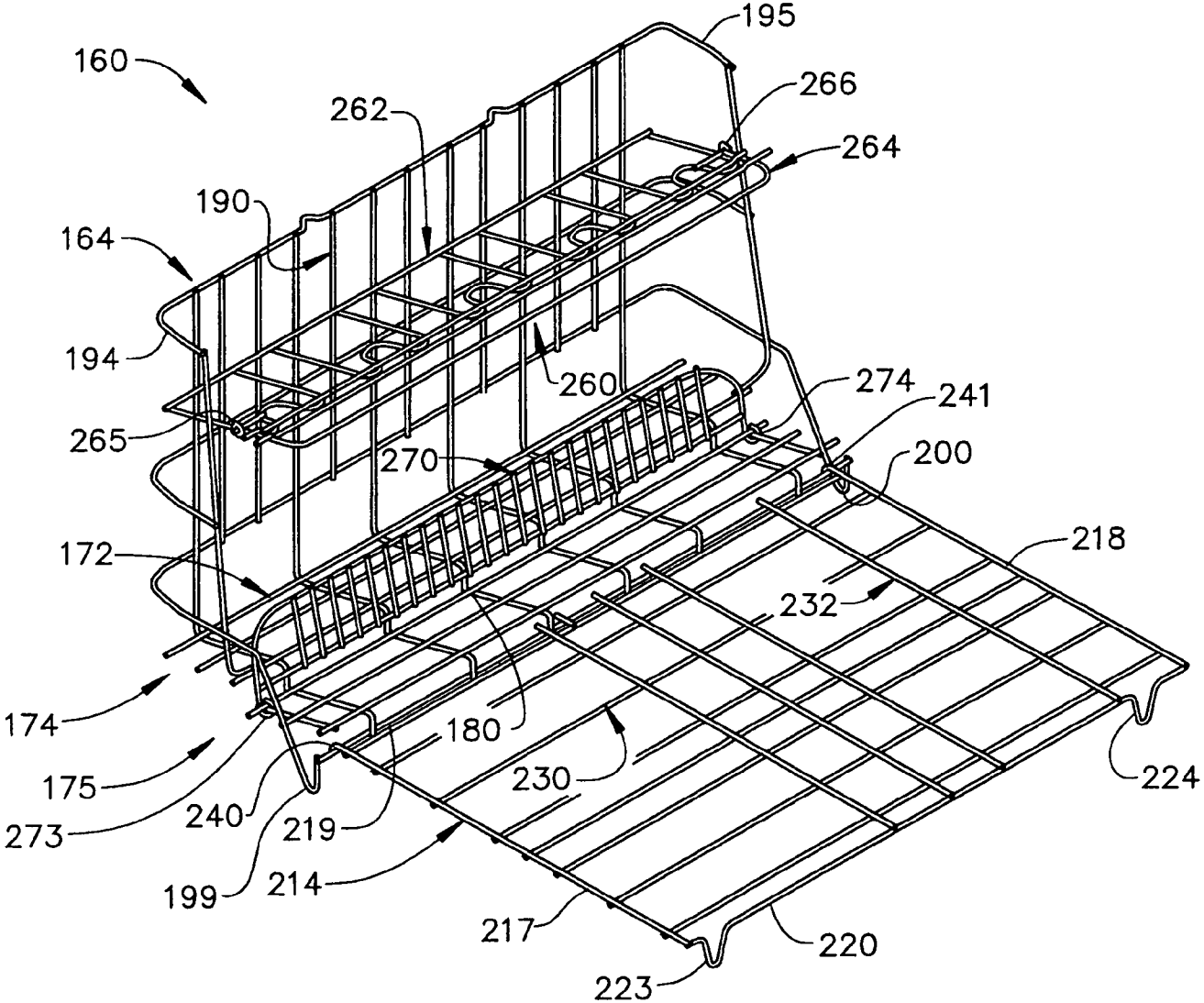
FIG. 6 is an upper right elevational view of the multi-piece dishrack of FIG. 4 showing optional accessories mounted to side portions of the dishrack.

Although not shown, base portion 166 can be provided with a plurality of tines which can be arranged in various configurations to establish specific dish support zones or regions. At this point, it should be understood that the present invention provides for a simple dishrack that allows a consumer to load dishware onto side portions and, if needed, readily remove a base portion without disturbing the dishes previously arranged on the side portions. Moreover, a consumer can access bottom wall 22 without having to remove the dishrack in its entirety. Of course, it should also be understood that racks 50 or 160 could be provided with various other accessories, such as those shown in FIG. 6. That is, side portion 164 could be provided with a first rack member 260 having a shelf portion 262 fixed to side portion 164, as well as a wall portion 264 pivotally attached for movement between raised and lowered (shown) positions relative to first and second side portions 194 and 195 about pivot joints 265 and 266 respectively. First rack member 260 provides an additional, raised supporting surface or structure for other dishware, such as glasses. Finally, side portion 164 is also shown to include a divider 270 which is pivotally mounted across base section 172 at stepped region 180. Divider 270 also defines first and second pivot joints 273 and 274, preferably constituted by looped, terminal wire portions, that allow divider 270 to be selectively pivoted to a fold-down position against second supporting surface 175. Divider 270 provides a barrier that prevents items resting upon first and second support surfaces 174 and 175 from contacting one and another during a washing operation.

Although described with reference to preferred embodiments of the invention, it should be readily understood that various changes and/or modifications can be made to the invention without departing from the spirit thereof. For instance, the dishracks are generally shown as being formed from coated wire, other materials, such as molded plastic, could also be employed. In general, the invention is only intended to be limited by the scope of the following claims.

We claim:

1. A dishwasher comprising:

a support body;

a tub arranged within the support body, said tub including bottom, rear and opposing side walls that collectively define a washing chamber; and a dishrack system for supporting articles to be washed in the washing chamber, said dishrack system including:

a side portion formed from a plurality of latticework elements, said side portion including a base section having first and second leg members and a back wall section, said side portion being supported in the tub with the leg members directly supporting the side portion upon the bottom wall, said base section extending across a minority of the bottom wall and the back wall section extending along one of the opposing side walls; and a base portion formed from a plurality of latticework members, said base portion extending across a majority of the bottom wall and having a first end supported directly upon the side portion and a second end supported by the bottom wall of the washing chamber whereby the base portion is configured to be removed from upon the side portion to allow access to the bottom wall of the tub without disturbing articles supported on the side portion.

2. The dishwasher according to claim 1, wherein the base portion includes:

a peripheral frame having front, rear and opposing side frame members;

a plurality of longitudinally extending support members extending between and being attached to the front and rear frame members; and a plurality of laterally extending support members extending between and being attached to the opposing side frame members.

3. The dishwasher according to claim 2, wherein the plurality of longitudinally extending support members includes first and second sets of longitudinally extending support members, said first and second sets of longitudinally extending support members having different lengths.

4. The dishwasher according to claim 3, wherein the first set of longitudinally extending support members includes first and second end portions, each of the first and second end portions projecting beyond the front and rear frame members respectively.

5. The dishwasher according to claim 4, wherein at least one of the first and second end portions includes a hook member adapted to engage with the base section.

6. The dishwasher according to claim 3, wherein the second set of longitudinally extending support members includes first and second end portions with the first end portion of the second set of longitudinally extending support members terminating at the front frame member.

7. The dishwasher according to claim 6, wherein the second end portions of the second set of longitudinally extending support members extend beyond the rear frame member.

8. The dishwasher according to claim 2, wherein the second end of the base portion includes a plurality of leg members formed in one of the opposing side frame members, said plurality of leg members directly supporting the second end of the base portion upon the bottom wall.

9. The dishwasher according to claim 2, wherein the dishrack system further includes another side portion, said another side portion including a base section having first and second leg members and a back wall section, the first and second leg members of said another side portion directly supporting the another side portion upon the bottom wall, with the back wall section of the another side portion extending along another of the opposing side walls.

10. The dishwasher according to claim 9, wherein the base portion is supported by the bottom wall through the another side portion.

11. The dishwasher according to claim 9, wherein the plurality of latticework members of the base portion include a plurality of laterally extending support members, each of said laterally extending support members including end portions that extend beyond the opposing side frame members such that the base portion rests upon the base section of the side portion and the another side portion respectively through the end portions of the plurality of laterally extending support members.

12. The dishwasher according to claim 11, wherein at least two of the laterally extending support members includes a respective hook that is adapted to engage with the base section.

13. The dishwasher according to claim 1, wherein the back wall section includes first and second in-turned end sections.

14. The dishwasher according to claim 13, wherein the base section includes first and second supporting surfaces interconnected by a stepped region.

15. The dishwasher according to claim 14, further comprising: a divider pivotally mounted to the side portion and extending across the base section at the stepped region.

16. The dishwasher according to claim 15, wherein said divider is selectively pivotable to a fold-down position against the second supporting surface.

17. The dishwasher according to claim 14, wherein each of the first and second supporting surfaces are sloped laterally outwardly and downwardly.

18. The dishwasher according to claim 13, further comprising: a rack member, said rack member including a shelf portion extending between and being supported by the first and second in-turned end sections.

19. The dishwasher according to claim 18, wherein the rack member includes a wall portion pivotally attached for movement between raised and lowered positions relative to the first and second in-turned end sections.

20. The dishwasher according to claim 1, wherein the tub includes a plurality of ribs integrally formed on one of the opposing side walls, said side portion being adapted to be supported by the plurality of ribs.

21. A drawer-type dishwasher comprising:

a support body;

a tub slidably supported within the support body through support glides, said tub including bottom, rear and opposing side walls that collectively define a washing chamber; and a dishrack system for supporting articles to be washed in the washing chamber, said dishrack system including:

a side portion formed from a plurality of latticework elements, said side portion including a base section having first and second leg members and a back wall section, said side portion being supported in the tub with the leg members directly supporting the side portion upon the bottom wall, said base section extending across a minority of the bottom wall and the back wall section extending along one of the opposing side walls; and a base portion formed from a plurality of latticework members, said base portion extending across a majority of the bottom wall and having a first end supported directly upon the side portion and a second end supported by the bottom wall of the washing chamber whereby the base portion is configured to be removed to allow access to the bottom wall of the tub without disturbing articles supported on the side portion.

* * * * *